US006374842B1

(12) United States Patent
Carter

(10) Patent No.: US 6,374,842 B1
(45) **Date of Patent: *Apr. 23, 2002**

(54) TRIANGULAR ERECTABLE SHELTER WITH FLEXIBLE ROOF ASSEMBLY

(76) Inventor: Mark C. Carter, 1601 Iowa Ave., Riverside, CA (US) 92507

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/131,147

(22) Filed: Aug. 7, 1998

(51) Int. Cl.[7] ..... E04H 15/50

(52) U.S. Cl. ..... 135/145; 135/97; 135/115; 135/119; 135/127

(58) Field of Search ..... 135/97, 143, 145, 135/151, 127, 131, 905, 908, 114, 115, 117, 119, 120.4; 52/109

(56) References Cited

U.S. PATENT DOCUMENTS

| | | | | | |
|---|---|---|---|---|---|
| 1,712,836 | A | | 5/1929 | Mills | |
| 1,853,367 | A | | 4/1932 | Mace | |
| 3,468,321 | A | * | 9/1969 | Thompson | 135/119 X |
| 3,965,915 | A | * | 6/1976 | Kirkham | 135/97 |
| 4,102,352 | A | * | 7/1978 | Kirkham | 135/97 |
| 4,407,317 | A | | 10/1983 | Crandall | |
| 4,601,301 | A | | 7/1986 | Hermanson | |
| 4,607,656 | A | | 8/1986 | Carter | |
| 4,641,676 | A | | 2/1987 | Lynch | |
| 4,947,884 | A | | 8/1990 | Lynch | |
| 5,035,253 | A | | 7/1991 | Bortles | |
| 5,244,001 | A | | 9/1993 | Lynch | |
| 5,275,188 | A | | 1/1994 | Tsai | |
| 5,511,572 | A | * | 4/1996 | Carter | 135/145 |
| 5,632,292 | A | * | 5/1997 | Carter | 135/145 |
| 5,632,293 | A | * | 5/1997 | Carter | 135/145 |
| 5,634,483 | A | | 6/1997 | Gwin | |

FOREIGN PATENT DOCUMENTS

| | | |
|---|---|---|
| AU | 25649/88 | 6/1992 |
| WO | WO 94/23162 | 10/1994 |

OTHER PUBLICATIONS

Copy of the International Search Report Relating to PCT/US99/15495 dated Nov. 2, 1999.

* cited by examiner

*Primary Examiner*—Carl D. Friedman
*Assistant Examiner*—Winnie Yip
(74) *Attorney, Agent, or Firm*—Fulwider Patton Lee & Utecht, LLP

(57) ABSTRACT

The triangular, wedge shaped erectable shelter includes a canopy and a leg assembly supporting the canopy. A perimeter truss linkage assembly is connected to the leg assembly, and each of the perimeter truss pairs includes first and second link members pivotally connected together in a scissors configuration, with the outer end of each first link member connected to the upper end of a leg, and the outer end of each second link slidably connected to the leg. The shelter includes a flexible pole member removably mountable to the upper end of at least one of the legs of the shelter to extend across the shelter and support the canopy of the shelter. The flexible pole member is preferably removably mounted in an indexing hole in a bracket affixed to the upper end of at least one of the legs. When the pole member is inserted in the index hole of the bracket, the pole member supports the canopy and can flex and move between a normal raised position and a lowered position by exertion of a downward force on the canopy, to reduce the profile of the shelter.

9 Claims, 5 Drawing Sheets

TRIANGULAR ERECTABLE SHELTER WITH FLEXIBLE ROOF ASSEMBLY

BACKGROUND OF THE INVENTION

FIELD OF THE INVENTION

This invention relates generally to folding, collapsible structures, and more particularly relates to a collapsible, field shelter structure having an elevated canopy.

DESCRIPTION OF RELATED ART

Temporary shelters that can be easily transported and rapidly set up at emergency sites can be particularly useful in providing temporary care and housing. Such shelters can also be useful for non-emergency outdoor gatherings, such as for temporary military posts, field trips, and the like. One such quickly erectable, collapsible shelter having a framework of X-shaped linkages, telescoping legs, and a canopy covering the framework has legs that are capable of telescoping to about twice their stowed length, and the framework of X-shaped truss pairs is capable of horizontal extension between the legs to support a canopy. The framework can be constructed of lightweight material, and the telescoping legs can be extended to raise the framework of the shelter. However, the canopy is essentially flat, allowing for collection of precipitation and debris on top of the canopy, which can promote leaks and tears in the canopy. In addition, the stability of such shelters, particularly in the face of strong winds, is generally limited by the strength of the framework, increasing the size and weight of such shelters when they are reinforced against the effects of winds.

A need therefore exists for an improved erectable shelter with a support framework shedding precipitation and debris from the top of the shelter, with a canopy presenting a low, wedge shaped profile and that bends and collapses in strong winds, to reduce exposure of the shelter to the force of winds that can lift and topple the shelter, for improved stability in winds. The present invention meets these needs.

SUMMARY OF THE INVENTION

Briefly, and in general terms, the present invention provides for a low cost, light weight erectable shelter with a triangular, wedge shape, and a low profile that allows for orientation of the shelter for reduction of effects of wind on the shelter, and with a flexible, collapsible canopy to provide a profile that flexes and becomes reduced in response to wind.

The present invention accordingly provides for a triangular, wedge shaped erectable shelter having a collapsed configuration and an extended configuration. The shelter comprises a canopy having three sides and three corners, and a leg assembly having three legs supporting the canopy. In a presently preferred aspect of the invention, the legs have telescoping upper and lower sections, with the lower section being adapted to engage the ground, and a slider member slidably mounted to the upper section of each of the legs. A perimeter truss linkage assembly comprising a plurality of perimeter truss pairs of link members is connected to the leg assembly. In a presently preferred embodiment, each of the perimeter truss pairs includes first and second link members pivotally connected together in a scissors configuration, with the outer end of each first link member connected to the upper end of a leg, and the outer end of each second link slidably connected to the leg.

In a presently preferred embodiment, the shelter includes a flexible pole member with one end removably mountable to the upper end of at least one of the legs of the shelter to extend across the shelter and support the canopy of the shelter. The free end of the flexible pole is received by a portion of the canopy of the shelter. The flexible pole member preferably comprises a plurality of pole sections that are removably connectable together by a cord, and are preferably removably mounted in an indexing hole in a bracket affixed to the upper end of at least one of the legs. When the pole member is inserted in the index hole of the bracket, the pole member supports the canopy and can flex and move between a normal raised position and a lowered position by exertion of a downward force on the canopy, to reduce the profile of the shelter.

These and other aspects and advantages of the invention will become apparent from the following detailed description and the accompanying drawings, which illustrate by way of example the features of the invention.

DETAILED DESCRIPTION OF THE PREFERRED EMBODIMENTS

Figure 1:
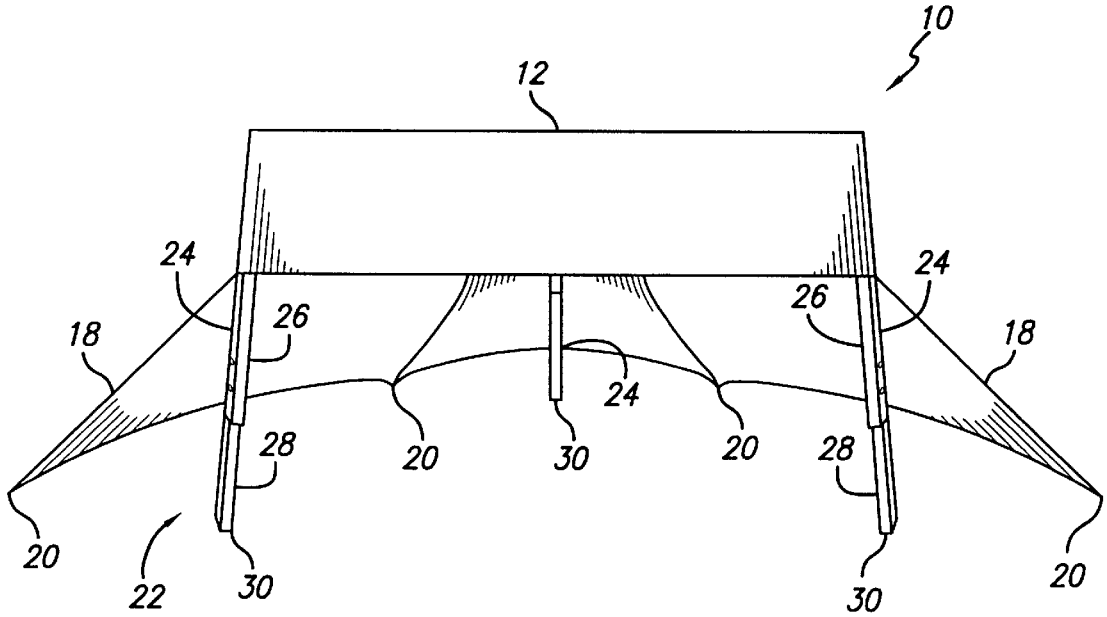
FIG. 1 is a front view of the erectable, collapsible shelter of the invention in an extended configuration.
Figure 2:
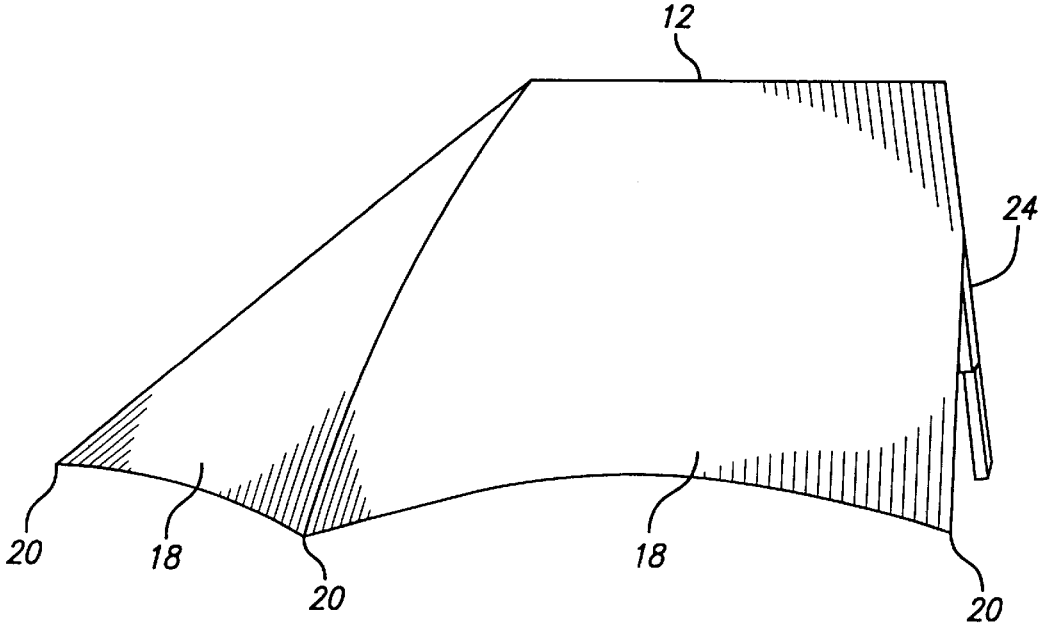
FIG. 2 is a side elevational view of the erectable, collapsible shelter of FIG. 1 in the extended configuration.
Figure 3:
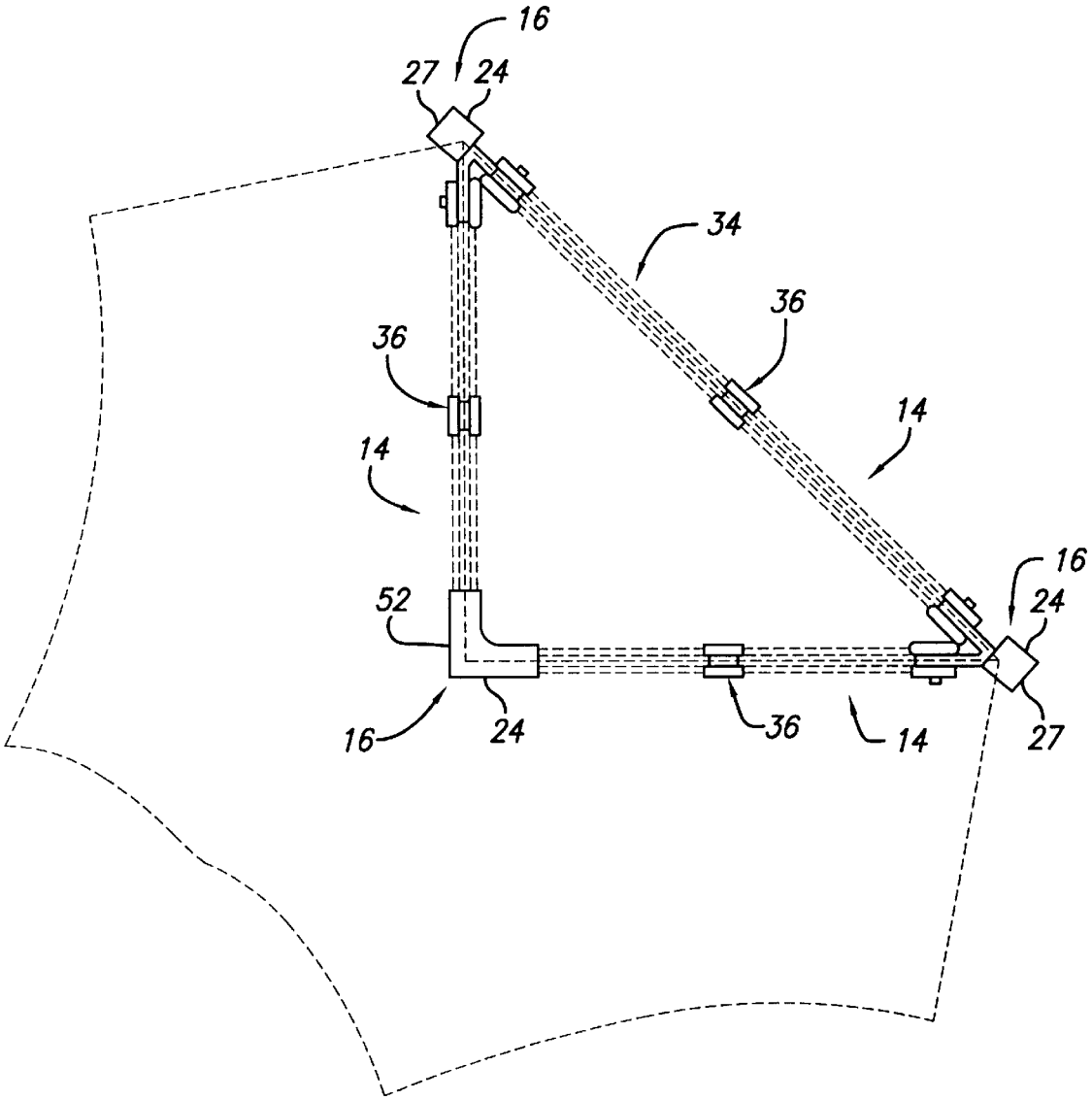
FIG. 3 is a top plan view of the erectable, collapsible shelter of FIG. 1 in the extended configuration.
Figure 4:
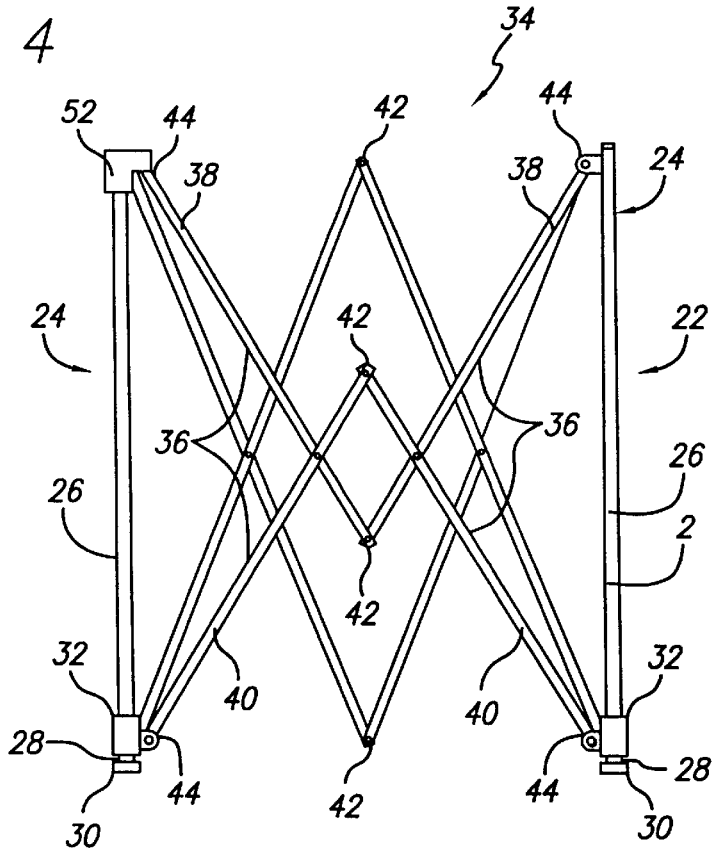
FIG. 4 is a side elevational view of one of the left side of the erectable, collapsible shelter of FIG. 1 in a collapsed configuration.

Erectable, collapsible shelters, in their expanded, erected configurations, typically have a canopy that presents a high profile that is susceptible to the effects of strong winds, and the stability of such shelters is generally limited by the strength of the framework, making them heavier and bulkier when they are reinforced against the effects of wind.

As is illustrated in the drawings, the invention accordingly is embodied in a triangular erectable shelter 10 having a collapsed configuration and an extended configuration.

The shelter includes a canopy 12 having three sides 14 and three corners 16, and is preferably made of a fabric, having trailing sections 18 with tethers 20 for anchoring to the ground, to form the general wedge shape of the shelter when the shelter is fully erected.

The canopy is supported by a leg assembly 22 having three legs 24 supporting the canopy. The legs are preferably formed of a telescoping upper section 26 having an upper end 27, and a lower section 28 having a foot 30 for engagement with ground. A slider member 32 is slidably mounted to each of the legs, and is preferably mounted to the upper section of each leg.

The legs of the leg assembly are connected together by a perimeter truss linkage assembly 34 having a plurality of perimeter truss pairs 36 of link members connected to the leg assembly. Each of the perimeter truss pairs includes first 38 and second 40 link members pivotally connected together in a scissors configuration, the first and second link members having inner 42 and outer 44 ends, the outer end of each the first link member connected to the upper end of a leg, with the outer end of each second link slidably connected to the leg.

Figure 6:
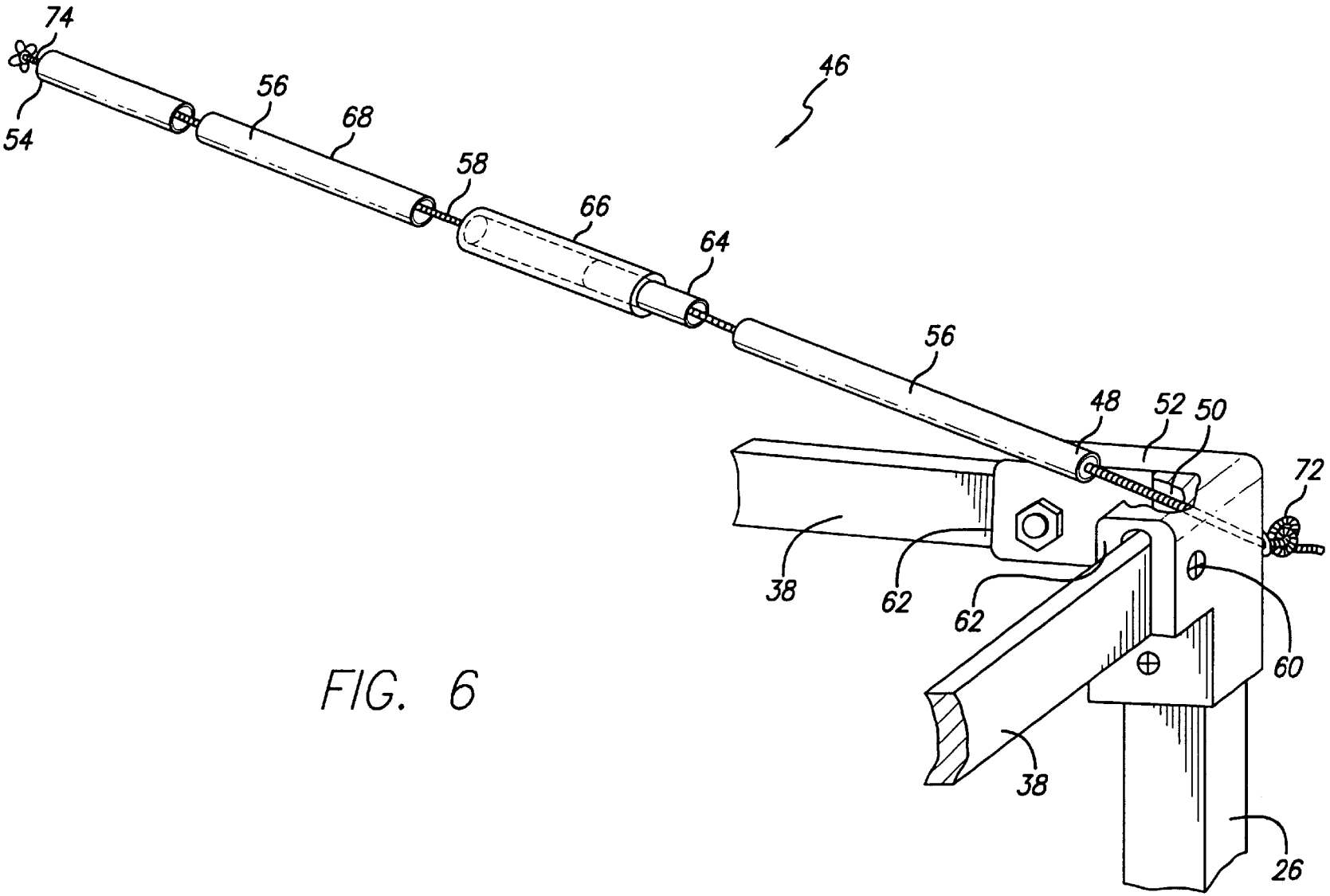
FIG. 6 is an enlarged perspective view of the bracket for connecting a flexible pole member to the top of a leg of the shelter of the invention.

In a presently preferred embodiment, as is illustrated in FIG. 6, the shelter additionally comprises a flexible pole member 46 having a first end 48 removably mountable to the upper end of at least one of the legs of the shelter to extend across the shelter. The first end of the pole member is preferably removably mounted in an indexing hole 50 in a bracket 52 affixed to the upper end of at least one of the legs. The second end 54 of the pole member is received by a portion of the canopy when the pole member is mounted in the mounting bracket. Thus, the free end 54 of the pole member extends across the top of the canopy and is received by a portion of the canopy to provide additional flexible support for the canopy. In a presently preferred embodiment, the flexible pole member comprises a plurality of pole sections 56 that are removably connectable together by a cord 58, such as an elastic cord, so that when the pole member sections are assembled, the pole member snaps together and is retained in an assembled condition by the cord. Thus, when the pole member is inserted in the index hole of the bracket, the pole member supports the canopy and can flex and move between a normal raised position and a lowered position by exertion of a downward force on the canopy, to reduce the profile of the shelter.

As is illustrated in FIG. 6, the outer end of each first link member is journalled by a bolt 60 for pivotal movement in a socket 62 of the bracket 52 secured as by bolts or screws as a cap to the top end of at least one of the legs. The bracket includes two sockets 62 extending at approximately right angles from each other from the body of the bracket. The bracket is preferably made unitarily from a tough, molded plastic.

In a currently preferred embodiment, the flexible pole member 46 preferably comprises a segmented flexible pole formed from two fiberglass pole sections 56 that are removably connectable together, with an inner end 64 of one of the pole sections bearing a metal jacket 66, made of aluminum or steel for example, into which the adjacent inner end 68 of the other pole section is insertable, to join the pole sections together. However, the flexible pole can be made from a variety of materials such as metal tubing, composite tubing (tubing made of resin impregnated fibers) or solid composite poles. The pole sections are preferably hollow, and the elastic cord 58 runs through the longitudinal centers of the pole sections. A first end 72 of the cord of the pole member extends through the indexing aperture 50 in the bracket, and is secured to the bracket such as by a knot. The second end 74 of the cord is secured to the second end 54 of the pole member, such as by a knot, so that the pole sections of the pole member are biased together. The pole member is removably receivable for mounting in the indexing aperture 50 in the bracket. Initially, when the pole member is connected together and inserted in the mounting bracket, the pole member supporting the canopy may be bowed downwardly, but can be pushed upward to snap into an upwardly bowed configuration. The pole member can flex and move from the raised position to a lowered position by pulling the pole member down, or by exertion of a downward force on the top of the canopy, such as by a strong wind, thus reducing the profile of the shelter that would be exposed to the wind.

Figure 5:
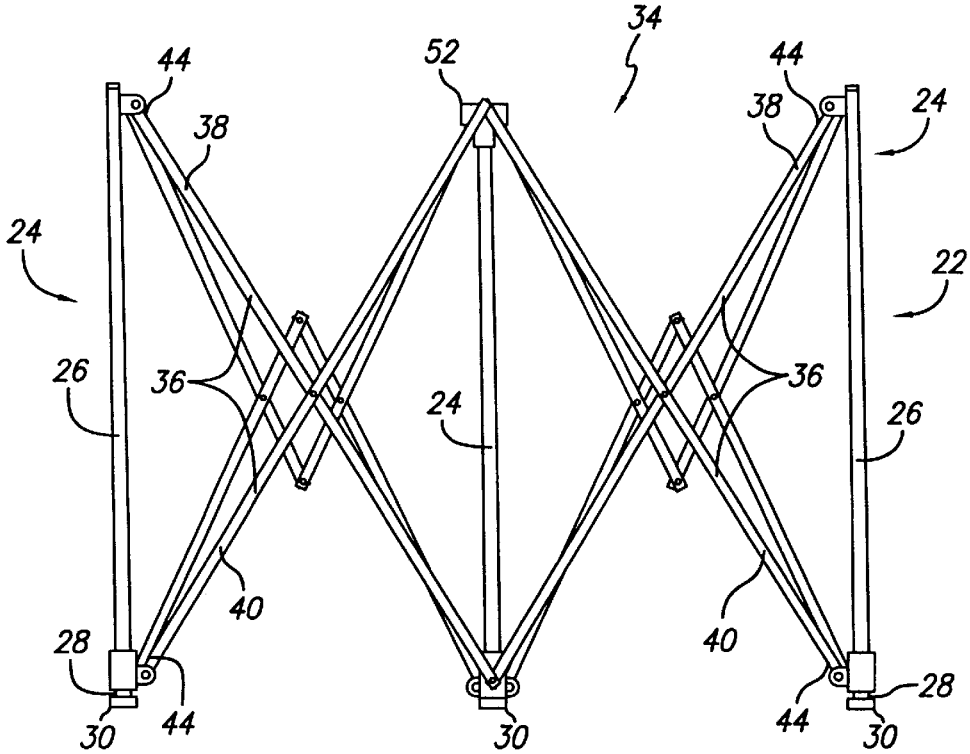
FIG. 5 is an elevational view of the front side of the erectable, collapsible shelter of FIG. 1 in a collapsed configuration.
Figure 7:
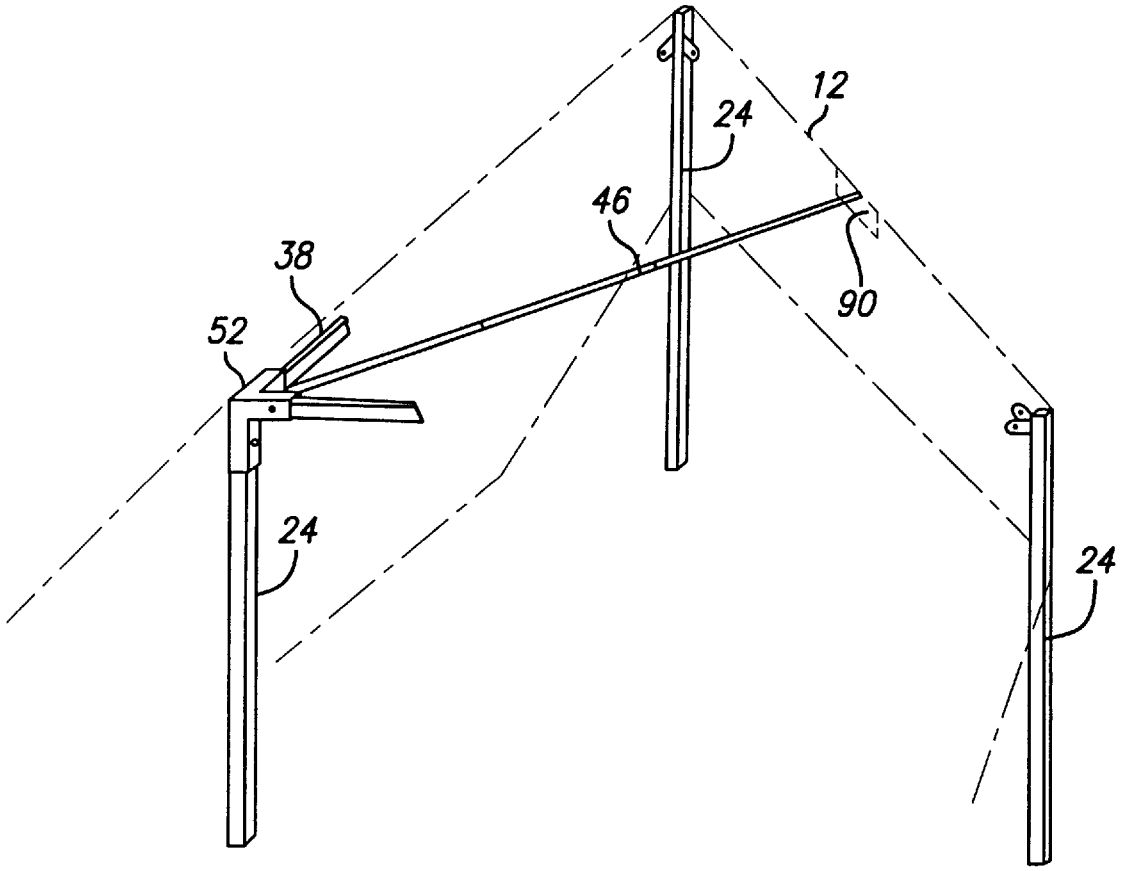
FIG. 7 is a side perspective view of the upper portion of the erectable, collapsible shelter of FIG. 2 showing the flexible pole mounted in the bracket of FIG. 6 and the free end of the flexible pole extending across the shelter.
Figure 8:
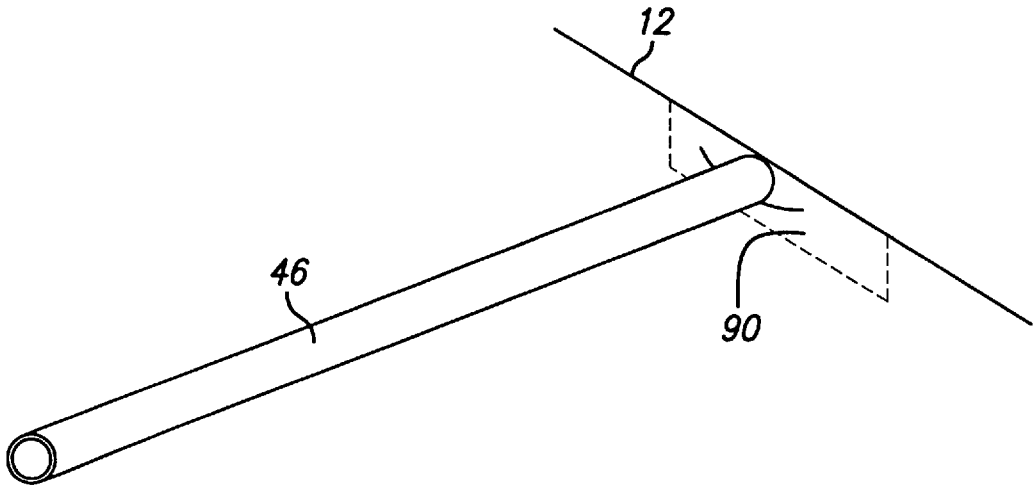
FIG. 8 is a partial perspective view looking at the underside of the canopy of the erectable, collapsible shelter of FIG. 1 showing the free end of the flexible pole of FIG. 7 received by a portion of the canopy.

Referring now to FIG. 7, the general construction of the upper portion of the leg assembly of the shelter is shown. Flexible member 46 is mounted in a bracket 52 affixed to the upper end of at least one of the legs 24. Legs 24 are generally connected, as illustrated in FIGS. 5 and 6, by link members 38, as well as other link members not shown in FIG. 7 for the sake of clarity. When mounted in bracket 52, the free end 54 of pole member 46 extends across the shelter to support the canopy 12. As shown further in FIG. 8, the free end 54 of pole member 46 is received by a portion 90 of the canopy 12. Receiving the free end of pole member 46 in this manner stabilizes the end of the pole member 46 to ensure support of the canopy 12.

What is claimed is:

1. A triangular erectable shelter having a collapsed configuration and an extended configuration, comprising:

a canopy having three sides and three corners, and a plurality of trailing sections adapted to extend to the ground, and a plurality of tethers on said trailing sections for anchoring said trailing sections to the ground;

a leg assembly having three legs supporting said canopy, said legs having an upper end and a lower end;

a perimeter truss linkage assembly having a plurality of perimeter truss pairs of link members connected to said leg assembly; and a flexible pole member having a first end and a second, free end, the flexible pole member being mounted at the first end to the upper end of one of the legs of the shelter, the flexible pole member extending across the shelter to support the canopy, and the second, free end of the flexible member being received by a portion of the canopy.

2. The triangular erectable shelter of claim 1, wherein said leg assembly comprises telescoping upper and lower sections.

3. The triangular erectable shelter of claim 1, wherein said leg assembly comprises a slider member slidably mounted to each of said legs.

4. The triangular erectable shelter of claim 3, wherein said slider member is mounted to upper section.

5. The triangular erectable shelter of claim 1, wherein each of said perimeter truss pairs comprises first and second link members pivotally connected together in a scissors configuration, said first and second link members having inner and outer ends, said outer end of each said first link member being connected to the upper end of one said leg, and said outer end of each second link being slidably connected to said leg.

6. The triangular erectable shelter of claim 1, wherein the flexible pole member comprises a plurality of pole sections that are connected together.

7. The triangular erectable shelter of claim 1, wherein the flexible pole member is removably mounted in an indexing hole in a bracket affixed to the upper end of at least one of the legs, and whereby when the pole member is inserted in the index hole of the bracket, the pole member supports the canopy and can flex and move between a normal raised position and a lowered position by exertion of a downward force on the canopy, to reduce the profile of the shelter.

8. The triangular erectable shelter of claim 1, wherein said canopy has one side without a trailing section, to provide an open side for entering and exiting the shelter.

9. The triangular erectable shelter of claim 8, wherein said plurality of trailing sections of said canopy comprises three trailing sections extending from two adjacent sides of said canopy.

* * * * *